US005154401A

United States Patent [19]

Schramm et al.

[11] Patent Number: 5,154,401

[45] Date of Patent: Oct. 13, 1992

[54] CORROSION FREE HIGH LOAD MARINE BLOCKS

[76] Inventors: David E. Schramm, 3937 Durano Ave., San Mateo, Calif. 94403; Karl L. Herbst, 23494 Sunset Dr., Los Gatos, Calif. 95030

[21] Appl. No.: 70,069

[22] Filed: Jul. 6, 1987

[51] Int. Cl.[5] ..... B66D 1/00

[52] U.S. Cl. ..... 254/416; 254/393; 254/390

[58] Field of Search ..... 254/393, 401, 404, 409, 254/412, 416, 901

[56] References Cited

U.S. PATENT DOCUMENTS

| | | | |
|---|---|---|---|
| 329,667 | 11/1885 | Moore | 254/404 |
| 1,681,947 | 8/1928 | Meany | 254/412 |
| 4,240,614 | 12/1980 | Comer | 254/416 X |
| 4,390,163 | 6/1983 | Merry | 254/412 |
| 4,391,567 | 7/1983 | Ciampolillo | 416/245 A X |

FOREIGN PATENT DOCUMENTS

| | | | |
|---|---|---|---|
| 728092 | 4/1955 | United Kingdom | 254/393 |

*Primary Examiner*—Katherine Matecki

*Attorney, Agent, or Firm*—David E. Newhouse

[57] ABSTRACT

A high strength, low friction, corrosion free block for marine environments includes a fixed or swivel head, shackle and a ground and polished axle all composed of 17-4 ph stainless steel sandwiched between titanium/-titanium alloy side cheeks. One or more aluminum sheaves each having a filament wound epoxy glass radial bushing with a Teflon liner are journaled around the axle. Oven cured Teflon filled thrust washers bonded to the sides of the sheave(s) turn against polished inner surfaces of the side cheeks. The blocks may include titanium/titanium alloy straps exterior the side cheeks supporting the axle to provide increased functional load bearing capacities ranging up to and exceeding 50,000 lbs.

11 Claims, 1 Drawing Sheet

FIGURE 1
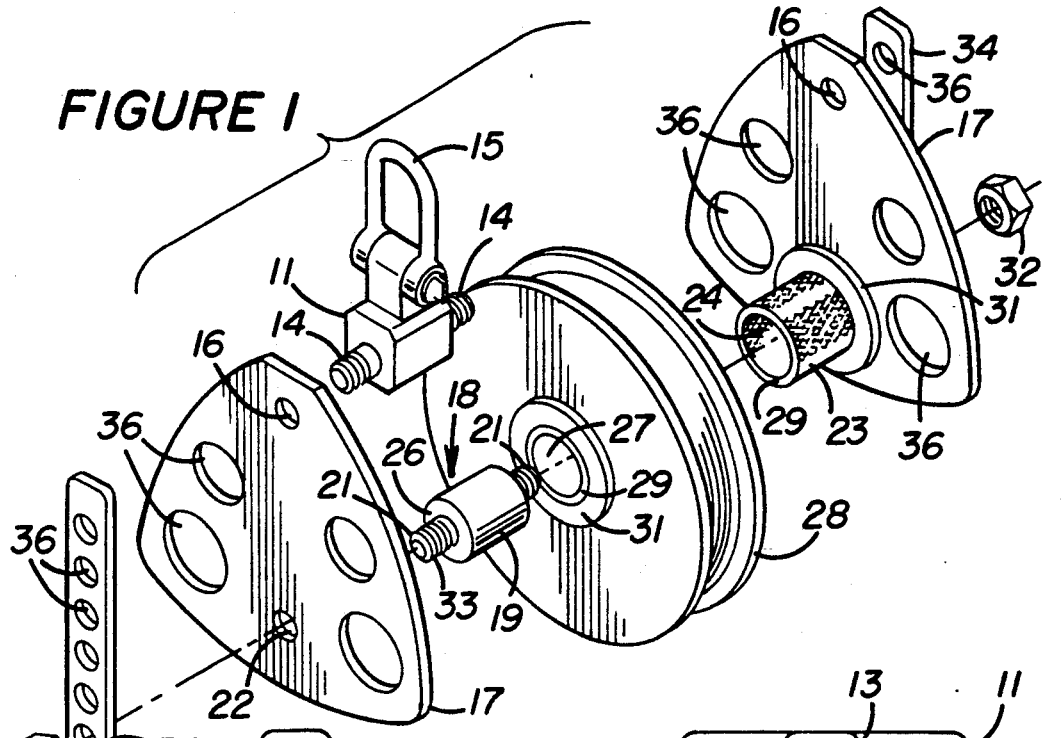
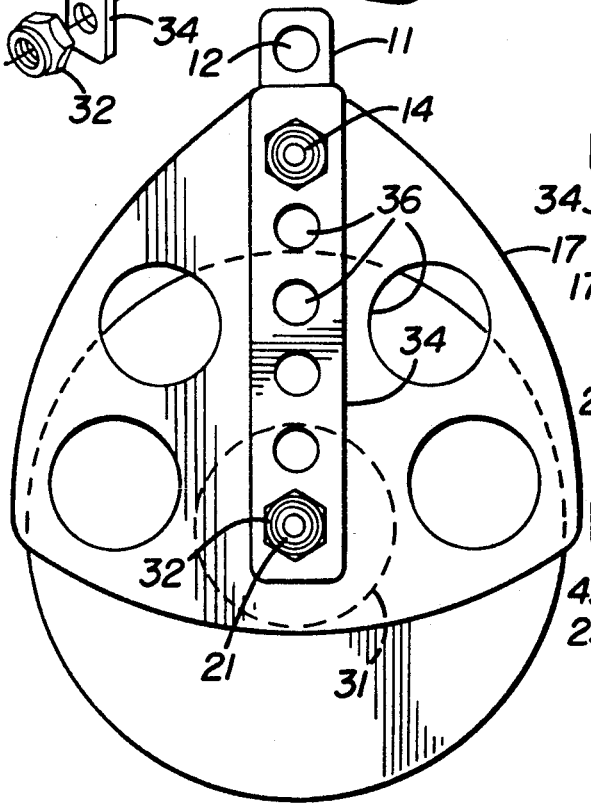
FIGURE 2
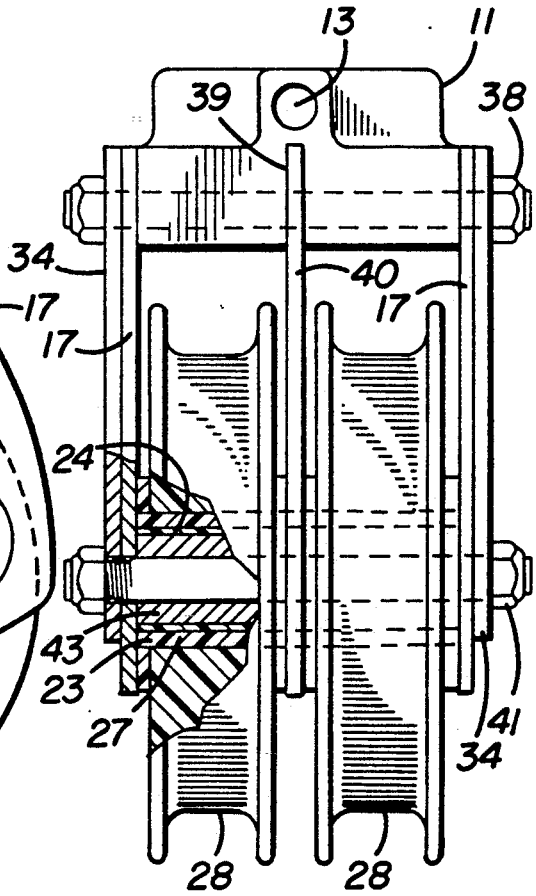
FIGURE 3

CORROSION FREE HIGH LOAD MARINE BLOCKS

BACKGROUND OF THE INVENTION

Sailing vessels require a number of blocks for raising, lowering and adjusting sails. A typical block includes a head, a shackle adapted to secure the head to the boat mast or deck, an axle, a structural frame coupling the head to the axle and a sheave journaled around the axle carrying a line connected to the sail. The turning sheave is typically protected by side cheeks which partially enclose the sheave.

Strength, weight and frictional resistance are the primary design factors for the principal blocks in competition sailing vessels. The objective is to have a block with maximum strength, minimum weight and minimal frictional resistance when loaded.

Because of the marine environment, corrosion factors impose very significant limits affecting design of such blocks. Specifically, corrosion determines of the types materials that can be used alone or in combination with others for constructing marine blocks. Corrosion is the result of electrochemical reactions in sea water environments and to a lesser degree in fresh water environments. Corrosion affects both performance and capacity of a block. For example, the effect of corrosion on the bearing surfaces between the sheave and the axle can significantly increase frictional resistance of the sheave rotating around the axle. Galvanic or "two metal" corrosion is even more catastrophic causing the bearing surfaces to unexpectedly seize, and structural components to suddenly fail upon repeated stress loads (corrosion fatigue).

Frequently, materials which by themselves or in combination should theoretically be very resistant to corrosion, corrode rapidly in sea water environments because of trace elements and/or contaminants within the material. For example, Aluminum alloys because of an oxide ($Al_2O_3$) film are considered relatively corrosion resistant and are frequently used in marine environments. Yet Aluminum alloys typically contain trace amounts of copper which, in a sea water give rise to numerous electrochemical corrosion reactions. Also, Aluminum is relatively high (electropositive) in the Activity Series (electromotive series) and will dissolve into and displace most other structural metals from electrolyte solutions. Hence in a sea water environment where abrasion removes the protective $AL_2O_3$ film coating, the aluminum alloys readily react electrochemically in a classic galvanic fashion.

For strength, typically the shackles, heads, axles and structural frames of marine blocks are formed from high strength structural materials such as steel capable of withstanding tensile loading. Sheaves are composed of light weight materials capable of withstanding compressive loading e.g. aluminum alloys. The side cheeks not being subjected any loads have not been composed of a structural material.

The bearing surfaces between the axles and frames or the axle and sheave typically determine the maximum functional load bearing capacity of a block. For example, a block that can structurally support substantial load ( e.g. above 15,000 lbs.) is useless if the sheave does not rotate when it is loaded. Further, friction between the bearing surfaces of the sheave and axle conventionally increases in direct proportion to the load supported. While, classically, lubricants are used to diminish the frictional resistance between bearing surfaces, not many lubricants are effective or last very long in the harsh environment of the sea. Further, the hardened steels from which bearings and bearing surfaces are typically made with the capacity to carry extremely high static and dynamic loads (in excess of 15,000 lbs) without significant deformation corrode rapidly in sea water.

Considering the forgoing parameters, in 1981 David E. Schramm, one the applicants here, designed a series of marine blocks for sailing vessels which included cast stainless steel heads and stainless steel axles, aluminum sheaves and cheeks, and a pair of exterior titanium/-titanium alloy straps connecting between the head and the axle to provide the structural frame.

Mr. Schramm utilized a filament wound epoxy glass bushing with a Teflon liner of the type manufactured by GARLOCK BEARING, INC. of Throfare, N.J. to provide the radial bearing surfaces between the a rotating sheave and stationary axle. This particular type of bushing was chosen because it is essentially inert in the sea water environment and because Teflon inherently becomes a better lubricant on smooth steel surfaces diminishing both static and rolling friction as load increases.

The exterior straps composed of titanium or one of it alloys were chosen because of their very high strength, low weight and resistance to corrosion particularly in sea water. (Titanium ranks 35th among the elements in terms of content in sea water with 1.1 kg. of titanium per cubic kilometer.)

One of the primary problems discovered with the series of marine blocks so designed and developed by David E. Schramm related to galvanic corrosion at the aluminum/steel interfaces, a factor which required all aluminum/steel contact to be eliminated.

Another significant problem discovered related to the rigidity of the frame structure in which the turning sheave was anchored. In particular, lateral support to mechanically prevent the sheave from wobbling as it rotated could not be effectively provided. Such wobble resulted from lateral static loading across the radial bearing and resulting deformation of that bearing under extreme load conditions.

The series of marine blocks so designed and developed by David E. Schramm were identified as the 900 Series Low Profile Blocks, the 1000 Series Blocks, the 2000 Series Blocks and the 2000-6 Series Blocks and since 1981 have been manufactured for and sold by MARINER COMPANY located in Southern, Calif.

SUMMARY OF THE INVENTION

The invented high strength, low friction, corrosion free block for marine environments includes a fixed or swivel head, shackle and a ground and polished axle all composed of 17–4 ph stainless steel sandwiched between titanium/titanium alloy side cheeks. One or more 6061-T6 machined aluminum sheaves each having a filament wound epoxy glass radial bushing with a Teflon liner are journaled around the axle. Oven cured Teflon filled thrust washers bonded to the sides of the sheave(s) turn against finished inner surfaces of the side cheeks. The blocks may include titanium/titanium alloy straps exterior the side cheeks supporting the axle to provide added functional load bearing capacity ranging up to and exceeding 50,000 lbs. depending on axle diameter.

The primary advantage of the invented block over the 900-2000 Series Blocks previously designed and developed by Mr. Schramm, relates to use of titanium rather than aluminum side cheeks thus eliminating wear and galvanic corrosion problems at the interfaces between the turning sheave and other components of the block.

The titanium side cheeks also function as an integral load bearing component of the frame structure of the block contributing considerably to it's strength in addition to protecting the rotating sheave and corralling the line. Accordingly, the overall bulk or volume of the block is reduced significantly without increasing weight.

Further it is not necessary to isolate titanium side cheeks from the 17-4 stainless steel head and axle components as is the case with aluminum side cheeks thus greatly simplifying the construction of both the head and axle components of the block. This factor also allows precision machine fitted construction of the components of the block to provide an extremely rigid frame structure for anchoring the turning sheave.

Also since titanium surfaces have very good wear characteristics, the inner surfaces of the side cheeks can be polished to provide an ideal thrust bearing seats for the Teflon filled thrust bearings bonded to either side of the turning sheave. This property combines with the rigidity of frame to prevent the turning sheave from wobbling as it rotates, i.e. the thrust bearing turning with the sheave against the finished inner surfaces of the side cheeks mechanically insure coaxial orientation and rotation of the sheave about the axle when it is subject to lateral loading (loading not perpendicular to the axle), without significantly increasing the frictional resistance to rotation of the sheave.

Other features, aspects, advantages and objects presented and accomplished by the invented block for marine environments will become apparent and/or be more fully understood with reference to the following description and detailed drawings.

BRIEF DESCRIPTION OF THE DRAWING

FIG. 1 is an exploded perspective view illustrating the components of the invented marine block having a single sheave.

FIG. 2 is a side elevation view of the invented marine block shown in FIG. 1.

FIG. 3 is a front elevation view of the invented marine block having a pair of sheaves.

DESCRIPTION OF A PREFERRED EMBODIMENT

As shown in FIGS. 1, & 2 the invented marine block comprises a 17-4 pH cast stainless steel head 11 with either a swiveling stationary anchoring eye 12 element adapted to be captured by a shackle 15 of slightly smaller diameter. The head 11 has pair of coaxial cylindrical shoulders 14 extending from either side adapted to be received by holes 16 drilled through the top of two pear shaped titanium side cheeks 17.

The pair of side cheeks 17 support a stationary cylindrical axle 18 having large diameter central bearing section 19 and smaller diameter ends 21 extending through holes 22 drilled through the midpoint bottom of the cheeks 17. A filament wound epoxy glass bushing 23 with a Teflon bonded inner liner 24 (the type manufactured by GARLOCK BEARING, INC. of Throfare, N.J.) is journaled around the central large diameter section 19 of the axle 18. As the block is loaded, the smaller diameter ends 21 of the axle 18 insure that any significant strain (deformation) occurs as shear at the junction of the side cheeks 17 with the annular faces 26 of the of the large diameter central section 19 of the axle, rather than as "bend" in the central section 19 of the axle 18. The elimination of "bend" preserves the 'roundness' of the cylindrical bushing 23 and liner 24 journaled around the central section 19 of the axle 18.

The epoxy glass bushing 23 is received and bonded within a central cylindrical axle aperture 27 of an aluminum sheave 28. The sheave 28 and bushing 23 turn as a unit around the stationary axle 18, the Teflon liner 24 providing the lubricant at the interface of the bushing and the surface of the central axle section 19. The surface of the central axle section 19 should be polished to enhance slipperiness under heavy loads.

A thrust washer 31 is bonded to either side of the sheave 28 and to the respective annular faces 29 of the epoxy glass bushing 23. The thrust washers 31 should present Teflon surfaces to the side cheeks 17. Conventional Teflon filled thrust washers have been found suitable. The inner faces of the side cheeks 17 may also be polished to decrease friction at the interface of the thrust washers 31 turning with the sheave 28 and the stationary cheeks. The combination of the bushing 23, and the respective thrust washers 31 sandwiching the bushing 23, effectively isolate the aluminum sheave 28 from contact with the remaining components of the invented marine block. Accordingly, care should be taken to insure continuous, high integrity bond interfaces between the sheave 28 and the filament wound epoxy glass bushing 23, and between the thrust washers 31 and the sheave sides 32, and annular faces 29 of the bushing 23.

Ideally, the cylindrical length of the thrust washer 31 bushing 23 sandwich should equal if not be very slightly greater than that of the central stationary axle section 19. Accordingly, upon securing the side cheeks 17 to extending axle ends 21, the thrust washer 31, bushing 23 and sheave 28 sandwich is slightly compressed as the cheeks 17 are snugged against the annular faces 26 on either end of the central axle section 19.

Any number of conventional means may be used to secure and snug the side cheeks 17 to the head 11 and axle 18. As shown in FIG. 1 threaded bolts 32 screwing onto helical threads 33 cut into the cylindrical shoulders 14 and axle ends 21 snug the side cheeks against the head and th e annular faces 26 of axle 18 to form a ridged rectilinear structure. To provide additional load carrying capacity, titanium straps 34 may be secured between the extending shoulders 14 and axle ends 21 exterior the side cheeks 17. For example, the working load capacity of a 4 inch block using 0.10 inch gauge sheet titanium for the side cheeks 17 can be increased from approximately 7,000 lbs. to 15,000 lbs by securing a strap 34 of like thickness (0.10 inch) between the head shoulders 14 and axle ends 21 on either side of the block. By increasing the thickness of the straps 34 to twice that of the cheeks the working load capacity can again be approximately doubled.

Holes 36 are cut or drilled though the titanium side cheeks 17 and straps 34 to lessen over all weight of the block and to decrease water retention due to capillary action and similar phenomenon between the respective elements of the block.

The chord dimensions across the pear or bell shaped side cheeks 17 should be slightly greater than the expected chord dimensions of the sheave 28 carrying a line (not shown). At their broadest point, the side cheeks 17 should be wider than the diameter of the sheave and line.

Various types of line may be carried by the sheave 27 including wire, Dacron and Kevlar.

FIG. 3 shows a double sheave block 37 with a cast 17-4 pH Stainless steel head 11 having a stationary anchor eye 13 A central cylindrical passageway 37 is drilled through the body of the head 11 for receiving a stainless steel bolt 38 threaded at each end. A central slot 39 is cut into the head perpendicularly intersecting the passageway 37 to receive a center titanium cheek 40. The axle 41 for the double sheave block comprises a central small diameter stainless steel bolt 42 threaded at either end, two larger diameter stainless steel bushings 43 disposed about the central bolt 42 on either side of the center cheek 40. As with the single sheave embodiment, filament wound epoxy glass bushings 23 with a Teflon bonded inner liners 24 (the type manufactured by GARLOCK BEARING, INC. of Throfare, N.J.) are received and bonded within central cylindrical axle apertures 27 of the two aluminum sheaves 28. The glass bushings 23 journal around the larger diameter stainless steel bushings 43. Annular Teflon filled thrust washers 31 are bonded to each face of the sheaves 28 and to the respective annular faces 29 of the epoxy glass bushings 23. Optional titanium straps 34 can be secured to the extending ends of the bolts 38 & 42 to provide additional working load capacity.

The side cheeks 17 and straps 34 may be composed of titanium or preferably, one of its alpha, alpha-beta or beta phase alloys such as TI-5AL-2.5Sn, Ti-6Al-4V, or Ti-3Al-13v-11Cr. In particular, most if not all titanium alloys exhibit the same resistance to corrosion as does titanium in its pure state and have the additional advantage of greater tensile and yield strengths. The titanium alloys noted for corrosion-resistance include Ti-35Al, Ti-50Al, Ti-75Al, Ti-0.2Pd, and Ti-2Ni. Galvanic reactions between the alloying agents in the titanium and the stainless steel alloy of which the head and axle are composed may limit the choice of suitable alloys to those without significant aluminum content.

The inner liner of 23 of the filament wound glass epoxy bushing and the thrust washers 31 of the invented block are preferably composed of one a class materials known as the fluorocarbon resins such as polytetrafluoroethylene (TEP), fluorinated ethylenepropylene (FEP), chlorotrifluoroethylene (CTFE) and polyvinylidene fluoride ($VF_2$). Such materials are commonly identified by trade names such as Teflon and Heflon. Fluorocarbon resins including the fluorelastomers are all relatively inert chemically, resistant to moisture weathering, ozone, and UV radiation. They are thermally stable over a wide range of temperatures. However, the primary factor in selecting the appropriate fluorocarbon resin for the liner 23 and to a lesser degree the thrust bearings 31 is the degree the lubricating properties of the particular fluorocarbon polymer increase as compression load increases.

The invented corrosion free marine block has been described in context of representative and/or preferred embodiments. Many modifications and variations can be made to the invented marine blocks which while not described herein, fall within the spirit and the scope of invention as described in the appended claims.

We claim:

1. In a block for use in marine environments including a stainless steel head element having a pair of oppositely extending coaxial cylindrical shoulders, a stationary, stainless steel, cylindrical axle having a large diameter central section and small diameter ends, an filament wound epoxy glass bushing with an inner liner composed of materials from a class consisting of fluorocarbon resins and fluoroelastomers which exhibit lubricating properties under conditions of high compression loading, the bushing being bonded coaxially within a cylindrical aperture through an aluminum sheave turning around the central large diameter section of the axle, the improvement comprising:

first and second planar side cheeks composed of a class of materials consisting of titanium, titanium alpha alloys, titanium alpha-beta alloys and titanium beta alloys each having a pair of spaced apart holes, one sized to receive a cylindrical shoulder of the head element, the other sized to receive a small diameter end of the axle;

means cooperating with the cylindrical shoulders of the head element and with the small diameter ends of the axle for securing the side cheeks to the head element and axle to provide a rigid structure;

a pair of thrust washers coaxially bonded to either side of the sheave.

2. The marine block of claim 1 wherein the planar side cheeks are a bell shaped and wherein the spaced apart holes are located on a line vertically bisecting the bell shape, one being a top hole located proximate the top of the bell shape, the other being a bottom hole located proximate the bottom of the bell shape, the top holes of the respective side cheeks receiving the oppositely extending cylindrical shoulders of the head element, the bottom holes receiving the small diameter ends of the cylindrical axle.

3. The marine block of claim 1 further including a pair of straps composed of materials from the class consisting of titanium, titanium alpha alloy, titanium alpha-beta alloy and titanium beta alloy, each having at least a pair of spaced apart holes one for receiving an extending cylindrical shoulders of the head element, the other for receiving an small diameter axle end, and wherein the cylindrical shoulders of the head element and the small diameter ends of the cylindrical axle each have a length sufficient to accommodate both a side cheek and a strap, the means cooperating with the respective shoulders and axle ends securing each strap exterior to each cheek.

4. In a block for use in marine environments including a stainless steel head element having a cylindrical passage way, at least one slot perpendicularly intersecting the passage way, a head bolt sized to be received in the cylindrical passage way through the head element with its ends extending from the passage way, a stationary, stainless steel axle bolt, at least a pair of annular stainless steel bushings coaxially receiving the axle bolt, at least a pair of filament wound epoxy glass bushing with an inner liner composed of materials from a class consisting of fluorocarbon resins and fluoroelastomers which exhibit lubricating properties under conditions of high compression loading, each glass bushing being bonded coaxially within a cylindrical aperture through an aluminum sheave and turning around one of the annular stainless steel bushings, the improvement comprising:

at least a first, second and third bell shaped planar side cheeks composed of a class of materials consisting of titanium, titanium alpha alloys, titanium alpha-beta alloys and titanium beta alloys, each cheek having a pair of spaced apart holes located on a line vertically bisecting the bell shape, one sized to receive the head bolt, the other sized to receive the axle bolt, each slot cut into the head element receiving one side cheek positioned such that the hole proximate the top of the bell shape registers with the cylindrical passage way through the head element, the holes proximate the top of the bell shape of a remaining pair of the side cheeks receiving the extending ends of the head bolt, whereby the head bolt passes through the passage way securing the side cheeks to the head element, and the holes proximate the bottom of the bell shaped side cheeks register coaxially for receiving the axle bolt, an annular stainless steel bushings with glass bushings and sheave being journaled around it being sandwiched between the side cheeks;

means cooperating with ends of the head and axle bolts for securing the side cheeks head element and axle bolt into a rigid structure; and a pair of thrust washers coaxially bonded to either side of each sheave.

5. The marine block of claims 1 or 4 wherein a portion of the surface of each side cheeks adjacent a thrust washer is polished.

6. The marine block of claims 1 or 4 wherein the thrust washers are filled with a material from a class consisting of fluorocarbon resins and fluoroelastomers which exhibit lubricating properties under conditions of high compression loading.

7. The marine block of claims 2 or 4 wherein the chord width of the bell shaped side cheeks measured perpendicularly relative to the vertical line bisecting the shape is slightly greater than that of the sheave carrying a rope trained around it.

8. The marine block of claim 7 wherein the maximum chord with of the bell shaped side cheeks measured perpendicularly relative to the vertical line bisecting the shape occurs at the hole through the side cheek at the bottom of the bell shape and is slightly greater than the diameter of the sheave.

9. The marine block of claim 8 wherein a plurality of apertures are cut through the planar side cheeks allowing water and air to circulate freely through regions of the block between each side cheek, and sheave.

10. The marine block of claim 4 further including a pair of straps composed of materials from the class consisting of titanium, titanium alpha alloy, titanium alpha-beta alloy and titanium beta alloy, each having at least a pair of spaced apart holes, one for receiving an extending end of the head bolt, the other for receiving an extending end of the axle bolt, and wherein the head bolt and the axle bolt each have a length sufficient to accommodate the straps extending extending through the particular holes of the straps, the means cooperating with the respective ends of the head and axle bolts securing each strap exterior to the exterior side cheek on either side of the block.

11. The marine block of claims 2 or 4 wherein the inner liner is composed of and the thrust washers are filled with a material from the class consisting of polytetrafluoroethylene (TEP), fluorinated ethylenepropylene (FEP), chlorotrifluoroethylene (CTFE) and polyvinylidene fluoride ($VF_2$).

* * * * *